US011946109B2

(12) United States Patent
Tobita

(10) Patent No.: US 11,946,109 B2
(45) Date of Patent: Apr. 2, 2024

(54) SPHEROIDAL GRAPHITE CAST IRON AND METHOD OF PRODUCING SPHEROIDAL GRAPHITE CAST IRON, AND VEHICLE UNDERCARRIAGE PARTS

(71) Applicant: KABUSHIKI KAISHA RIKEN, Tokyo (JP)

(72) Inventor: Tomoyuki Tobita, Tokyo (JP)

(73) Assignee: KABUSHIKI KAISHA RIKEN, Chiyoda-ku (JP)

( * ) Notice: Subject to any disclaimer, the term of this patent is extended or adjusted under 35 U.S.C. 154(b) by 70 days.

(21) Appl. No.: 17/595,000

(22) PCT Filed: Apr. 14, 2020

(86) PCT No.: PCT/JP2020/016462
§ 371 (c)(1),
(2) Date: Nov. 5, 2021

(87) PCT Pub. No.: WO2020/226037
PCT Pub. Date: Nov. 12, 2020

(65) Prior Publication Data

US 2022/0213568 A1 Jul. 7, 2022

(30) Foreign Application Priority Data

May 7, 2019 (JP) ..... 2019-087757

(51) Int. Cl.
*C21D 5/00* (2006.01)
*C21C 1/10* (2006.01)
(Continued)

(52) U.S. Cl.
CPC ..... *C21D 5/00* (2013.01); *C21C 1/10* (2013.01); *C22C 33/04* (2013.01); *C22C 37/04* (2013.01); *C21D 2211/009* (2013.01)

(58) Field of Classification Search
CPC ..... C21C 1/10; C21C 1/105; C22C 33/08; C22C 33/10; C22C 33/12; C22C 33/04;
(Continued)

(56) References Cited

U.S. PATENT DOCUMENTS 5,346,561 A 9/1994 Obata et al.
5,876,523 A 3/1999 Nagayoshi et al.
(Continued)

FOREIGN PATENT DOCUMENTS

JP S5921379 B2 5/1984
JP H0813079 A 1/1996
(Continued)

OTHER PUBLICATIONS

Machine translation of JP2000026932A (Year: 2000).*
(Continued)

*Primary Examiner* — Brian D Walck
*Assistant Examiner* — Nazmun Nahar Shams
(74) *Attorney, Agent, or Firm* — KENJA IP LAW PC

(57) ABSTRACT

A spheroidal graphite cast iron having a chemical composition of: C: 3.0% to 4.0%, Si: 2.0% to 2.4%, Cu: 0.20% to 0.50%, Mn: 0.15% to 0.35%, S: 0.005% to 0.030%, Mg: 0.03% to 0.06%, each by mass, and the balance being Fe and inevitable impurities, where Mn and Cu are contained at 0.45% to 0.75% in total; and a structure in which a ferrite layer encloses spheroidal graphite crystallized out in a matrix of pearlite. Part of the pearlite is extended from the matrix side to the spheroidal graphite side to divide the ferrite layer at one or more areas.

9 Claims, 7 Drawing Sheets

(51) Int. Cl.
*C22C 33/04* (2006.01)
*C22C 37/04* (2006.01)

(58) Field of Classification Search
CPC ..... C22C 37/04; C21D 2211/004; C21D 2211/005; C21D 2211/006; C21D 2211/009; C21D 5/00
See application file for complete search history.

(56) References Cited

U.S. PATENT DOCUMENTS

| | | | | |
|---|---|---|---|---|
| 2014/0251751 | A1 | 9/2014 | Park | |
| 2014/0271330 | A1 | 9/2014 | Horiya et al. | |
| 2014/0352851 | A1* | 12/2014 | Wang | C21D 5/00 148/543 |
| 2016/0160325 | A1* | 6/2016 | Mito | C22C 33/08 420/15 |

FOREIGN PATENT DOCUMENTS

| | | | |
|---|---|---|---|
| JP | 2002317238 | A | 10/2002 |
| JP | 2007197747 | A * | 8/2007 |
| JP | 6079641 | B2 | 2/2017 |
| WO | 2013100148 | A1 | 7/2013 |

OTHER PUBLICATIONS

Nov. 2, 2021, International Preliminary Report on Patentability issued in the International Patent Application No. PCT/JP2020/016462.
Jul. 21, 2020, International Search Report issued in the International Patent Application No. PCT/JP2020/016462.
May 11, 2021, Notification of Reasons for Refusal issued by the Japan Patent Office in the corresponding Japanese Patent Application No. 2019-087757.
Jun. 1, 2022, Office Action issued by the China National Intellectual Property Administration in the corresponding Chinese Patent Application No. 202080032720.X.
Mar. 2, 2022, Office Action issued by the China National Intellectual Property Administration in the corresponding Chinese Patent Application No. 202080032720.X.
Mar. 24, 2023, Office Action issued by the Directorate General of Intellectual Property in the corresponding Indonesian Patent Application No. P00202109526.
Nov. 28, 2023, the Extended European Search Report issued by the European Patent Office in the corresponding European Patent Application No. 20802957.9.

* cited by examiner

SPHEROIDAL GRAPHITE CAST IRON AND METHOD OF PRODUCING SPHEROIDAL GRAPHITE CAST IRON, AND VEHICLE UNDERCARRIAGE PARTS

CROSS-REFERENCE TO RELATED APPLICATIONS

This application claims priority to Japanese Patent Application No. 2019-087757 filed on May 7, 2019, the entire disclosure of which is incorporated herein by reference.

TECHNICAL FIELD

The present disclosure relates to a spheroidal graphite cast iron, and particularly relates to a spheroidal graphite cast iron having high strength and high ductility such that it can be used in vehicle undercarriage parts of automobiles.

BACKGROUND

In recent years, in terms of environmental conservation and energy conservation, the weight of automobiles has been reduced, and there is a demand for lighter vehicle undercarriage parts, for example, lighter steering knuckles (hereinafter, also referred to as knuckles). Increasing the strength of the materials to be used helps to reduce the weight of vehicle undercarriage parts. Conventionally, materials of grades of FCD450-10 and FCD550-7 as defined in JIS standards have been used as materials of vehicle undercarriage parts; however, there is a demand for materials having even higher tensile strength than those materials.

Examples of materials having high tensile strength include conventional grade FCD700 materials. Using conventional grade FCD700 materials as materials of vehicle undercarriage parts has also been considered. However, although conventional grade FCD700 materials are high in tensile strength, they are low in elongation and tenacity. Accordingly, when a conventional grade FCD700 material is used as a material of a vehicle undercarriage part such as a knuckle, elongation and tenacity are insufficient so that it is possible that the vehicle undercarriage part fractures in case of a vehicle collision.

Now, cast irons having a two phase mixture are known as raw materials exhibiting high elongation and tenacity. Accordingly, a cast iron having a two phase mixture in which ferrite and pearlite are mixed can be obtained by controlling the cooling temperature after casting and heat treatment. An example of such a cast iron having a two-phase mixed structure is a spheroidal graphite cast iron disclosed in JP 6079641 B (PTL 1) below.

PTL 1 discloses a spheroidal graphite cast iron with high strength and tenacity, having (a) a composition comprising by mass 3.4% to 4% of C, 1.9% to 2.8% of Si, 0.02% to 0.06% of Mg, 0.2% to 1% of Mn, 0.2% to 2% of Cu, 0% to 0.1% of Sn, 0.85% to 3% of (Mn+Cu+10×Sn), 0.05% or less of P, and 0.02% or less of S, and the balance being Fe and inevitable impurities; and (b) a duplex matrix structure comprising by area 2% to 40% of fine ferrite phases and 60% to 98% of fine pearlite phases, and the maximum length of the ferrite phases being 300 μm or less; and (c) the pearlite phases being formed around graphite particles dispersed in the duplex matrix structure.

The use of a cast iron having a two-phase mixed structure as described above as a material of vehicle undercarriage parts have been contemplated.

CITATION LIST

Patent Literature

PTL 1: JP 6079641 B

SUMMARY

Technical Problem

However, since a two-phase mixed structure as described above has insufficient tenacity, there has been a demand for a material having higher strength, higher ductility, and higher tenacity.

It could therefore be helpful to provide a spheroidal graphite cast iron having high strength, high ductility, and high tenacity, particularly a spheroidal graphite cast iron having high strength with a high tensile strength of 700 MPa or more, exhibiting an elongation of 10% or more, and exhibiting an absorbed energy of 10.0 J/cm$^2$ or more at room temperature.

Solution to Problem

The inventors of this disclosure diligently studied ways to address the above challenges.

As a result, they found that maintaining a structure containing ferrite and pearlite at temperatures of 800° C. or more and 850° C. or less for a time of more than 30 min and 240 min or less, followed by cooling makes it possible to obtain a novel spheroidal graphite cast iron having a structure in which perlite penetrates into a ferrite layer enclosing graphite in an intricate manner.

In this structure, unlike in conventional techniques, the ferrite layer enclosing graphite is not completely divided, and in this structure, the ferrite layer is continuous by having a shape like a net (mesh) into which pearlite penetrates in an intricate manner. Since the ferrite layer has a continuous net-like shape, much soft ferrite can be made to be present on the course of tension and impact fracture, which can prevent the propagation of fractures, resulting in high strength, high ductility, and high tenacity all at once.

It should be noted that in this specification, when a spheroidal graphite cast iron has a tensile strength of 700 MPa or more and an elongation of 10% or more, and an energy absorbed by the cast iron in the Charpy impact test is 10.0 J/cm$^2$ or more, the spheroidal graphite cast iron is deemed to have high strength, high ductility, and high tenacity.

Specifically, this disclosure primarily includes following features.

(1) A spheroidal graphite cast iron comprising:

a chemical composition of:

C: 3.0% to 4.0%,

Si: 2.0% to 2.4%,

Cu: 0.20% to 0.50%,

Mn: 0.15% to 0.35%,

S: 0.005% to 0.030%,

Mg: 0.03% to 0.06%, each by mass, and the balance being Fe and inevitable impurities, where Mn and Cu are contained at 0.45% to 0.75% in total; and a structure in which a ferrite layer encloses spheroidal graphite crystallized out in a matrix of pearlite, wherein in the structure, part of the pearlite is extended from the matrix side to the spheroidal graphite side to divide the ferrite layer at one or more areas.

(2) The spheroidal graphite cast iron according to (1) above, wherein the cast iron has a tensile strength of 700 MPa or more and an elongation of 10% or more, and an absorbed energy at room temperature is 10.0 J/cm$^2$ or more.

(3) The spheroidal graphite cast iron according to (1) or (2) above, wherein an area ratio of the ferrite layer relative to the entire structure is 20% to 55%.

(4) A method of producing a spheroidal graphite cast iron, comprising:

performing soaking on a cast material having a chemical composition of:

C: 3.0% to 4.0%,

Si: 2.0% to 2.4%,

Cu: 0.20% to 0.50%,

Mn: 0.15% to 0.35%,

S: 0.005% to 0.030%,

Mg: 0.03% to 0.06%, each by mass, and the balance being Fe and inevitable impurities, where Mn and Cu are contained at 0.45% to 0.75% in total, by retaining the cast material at temperatures of 800° C. or more and 850° C. or less for a time of more than 30 min and 240 min or less; and cooling the cast material after the soaking.

(5) A vehicle undercarriage part comprising the spheroidal graphite cast iron according to any one of (1) to (3) above.

Advantageous Effect

This disclosure can provide a spheroidal graphite cast iron having high strength, high ductility, and high tenacity that has a high tensile strength of 700 MPa or more, has an elongation of 10% or more, and exhibits an absorbed energy of 10.0 J/cm$^2$ or more at room temperature.

DETAILED DESCRIPTION

Figure 1A:
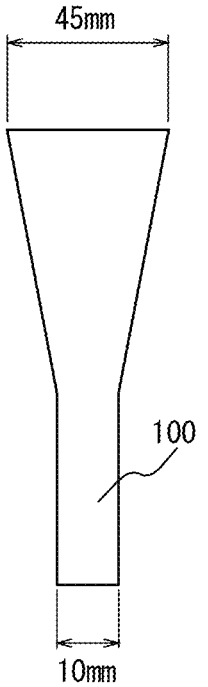
FIG. 1A is a diagram illustrating the cavity shape of molds used in Examples 1 and 2 and FIG. 1B is a diagram illustrating the size of a produced Y-shaped sample.

Spheroidal graphite cast irons according to embodiments of this disclosure will now be described. First, the chemical composition of a spheroidal graphite cast iron is limited as described above for the following reasons. Unless otherwise specified, "%" indicating the content of each component element herein means "% by mass". Further, a numerical range defined using "to/–" means a range including the numeric values put before and after "to/–" as the lower limit value and the upper limit value, respectively.

C: 3.0% to 4.0%

Carbon (C) is an element essential for a graphite structure. When the content of C is less than 3.0%, graphite is hardly crystallized out. For example, in some cases, carbides (chills) are crystallized out in thin parts of a knuckle, so that the disclosed structure might not be obtained by heat treatment to be described (hereinafter, may simply be referred to as heat treatment). When the content of C exceeds 4.0%, the grain size of graphite can be larger and exploded graphite having a reduced spheroidizing ratio can be formed, which would result in lower tensile strength, elongation, and tenacity after heat treatment. Accordingly, the content of C is set to 3.0% to 4.0%. The content of C is preferably set to 3.3% or more, more preferably 3.4% or more. Meanwhile, the content of C is preferably set to 3.8% or less, more preferably 3.7% or less.

Si: 2.0% to 2.4%

Silicon (Si) is an element that promotes the crystallization of graphite in a cast material. When the content of Si is less than 2.0%, graphite is hardly crystallized out. For example, in some cases, chills are crystallized out in thin portions of a knuckle, so that the disclosed structure might not be obtained by heat treatment. When the content of Si exceeds 2.4%, the amount of Si solid solution in ferrite would be high and silicon ferrite having high hardness would be formed, resulting in reduced tenacity during heat treatment to be described. Accordingly, the content of Si is set to 2.0% to 2.4%. The content of Si is preferably set to 2.1% or more, more preferably 2.2% or more. Meanwhile, the content of Si is preferably set to 2.3% or less.

Note that for a cast material, when the content of Si is within the relatively low range as specified above, typically, the area ratio of ferrite with respect to the whole structure (hereinafter, may simply be referred to as the area ratio of ferrite) is low. A chemical composition having a low content of Si makes it difficult to obtain high strength and a high ferrite area ratio. A technique according to this disclosure also makes it possible to obtain high strength and a high ferrite ratio that have been hardly obtained in a cast material having a low Si content, by performing heat treatment.

Cu: 0.20% to 0.50%

Copper (Cu) is an element that stabilizes pearlite and is necessary for obtaining an intended tensile strength value by heat treatment. When the content of Cu is less than 0.2%, the tensile strength is insufficient and the disclosed structure is hardly obtained. When the content of Cu exceeds 0.5%, the area ratio of pearlite with respect to the whole structure after heat treatment (hereinafter, may simply be referred to as pearlite area ratio) is high and an intended elongation would not be obtained. Accordingly, the content of Cu is set to 0.2% to 0.5%. The content of Cu is preferably set to 0.25% or more, more preferably 0.30% or more. Meanwhile, the content of Cu is preferably set to 0.47% or less, more preferably 0.4% or less.

Further, Cu is also an element necessary for obtaining the disclosed structure by heat treatment. In this disclosure, the disclosed structure is obtained by performing heat treatment on a spheroidal graphite cast iron having a so-called bull's eye structure under predetermined conditions. When the content of Cu is low, after a spheroidal graphite cast iron having the bull's eye structure is subjected to heat treatment, during cooling, the C component in austenite is diffusively transferred to the graphite structure to be regraphitized (secondary graphite), thus the structure intended in this disclosure is not formed and the structure would return to the bull's eye structure. However, in this disclosure, since the ratio of Cu contained is within the above-mentioned range, graphite is covered in film-like Cu, and the C component in austenite is prevented from being diffusively transferred to the graphite structure by virtue of the barrier effect of Cu. Thus, the structure does not return to the bull's eye structure during cooing, and the disclosed structure can be obtained.

Mn: 0.15% to 0.35%

Manganese (Mn) is an element that stabilizes pearlite. When the content of Mn is less than 0.15%, pearlite is insufficient, resulting in reduced strength. The disclosed structure can be obtained by adding Cu mentioned above. Specifically, the disclosed cast iron contains Mn and Cu that is also an element that stabilizes pearlite, thus when the content of Mn exceeds 0.35%, pearlite is excessive, and the elongation and tenacity is low. Accordingly, the content of Mn is set to 0.15% to 0.35%. Preferably, the content of Mn is set to 0.2% or more. Meanwhile, the content of Mn is preferably set to 0.3% or less.

S: 0.005% to 0.030%

When the content of S is less than 0.005%, the amount of sulfide that serves as nuclei of crystallizing spheroidal graphite is small. Accordingly, when the content of S is less than 0.005%, the amount of spheroidal graphite crystallized out is small, which would reduce the spheroidizing ratio. A content of S exceeding 0.030% inhibits graphitization and reduces the spheroidizing ratio of graphite. Accordingly, the content of S is set to 0.005% to 0.030%. The content of S is preferably set to 0.020% or less, more preferably 0.010% or less.

Mg: 0.03% to 0.06% Magnesium (Mg) is an element that has effects on the spheroidization of graphite. When the content of Mg remaining in a cast iron (hereinafter, also referred to as residual Mg content) is less than 0.03%, the graphite spheroidizing ratio is low, which would reduce the tensile strength, elongation, and tenacity during heat treatment. When the residual Mg content exceeds 0.06%, chills would be crystallized out and the disclosed structure would not be obtained. Accordingly, the content of Mg is set to 0.03% to 0.06%. Preferably, the content of Mg is set to 0.04% or more. Meanwhile, the content of Mg is preferably set to 0.05% or less.

Mn+Cu: 0.45% to 0.75%

In addition to the contents specified above, the total content of Mn and Cu is also required to be limited. Specifically, when the total content of Mn and Cu is less than 0.45%, the tensile strength is not sufficiently improved by heat treatment. On the other hand, when the total content exceeds 0.75%, the ratio of perlite is increased by heat treatment, which would reduce the elongation and tenacity. Preferably, the total content of Mn and Cu added is 0.55% or more.

Thus, base components of the disclosed cast iron have been described. The remainder other than the above components consists of Fe and inevitable impurities. Examples of the inevitable impurities include P and Cr. For the contents of the inevitable impurities, the content of P is approximately less than 0.05% and the content of Cr is approximately 0.1% or less.

Next, the structure of the disclosed spheroidal graphite cast iron will be described.

The disclosed spheroidal graphite cast iron has a structure in which perlite penetrates into a ferrite layer enclosing spheroidal graphite in an intricate manner.

More specifically, the structure of the disclosed spheroidal graphite cast iron is a mixed structure in which perlite penetrates into a ferrite layer enclosing spheroidal graphite in an intricate manner so that at least one area of the ferrite layer enclosing spheroidal graphite is divided by fine pearlite. In this specification, the expression "fine pearlite divides the ferrite layer enclosing graphite" means that pearlite penetrates to graphite in a boundary region between spheroidal graphite and ferrite.

The structure of PTL 1 mentioned above is a fine mixed matrix structure including ferrite phases and fine pearlite phases, that is, a fine mixed matrix structure of ferrite grains and pearlite grains, in which the ferrite phases are finely dispersed with the fine pearlite phases therebetween. In the structure of PTL 1, the mechanical properties of fine pearlite phases having a high area ratio are predominant, and since the ferrite phases are finely dispersed with the fine pearlite phases therebetween, the mechanical properties of the ferrite phases cannot be sufficiently exerted.

On the other hand, in the disclosed structure, pearlite penetrates the ferrite layer enclosing graphite in an intricate manner without finely dispersing the ferrite layer, and the ferrite layer has, instead of grains, clusters of grains that are connected and joined to each other. In this unique structure, the ferrite layer is not finely dispersed, thus the mechanical properties of ferrite are not impaired. Further, fine pearlite in the ferrite layer exerts mechanical properties like reinforced fiber. The unique structure of the disclosed spheroidal graphite cast iron provides mechanical properties of both ferrite and pearlite.

The area ratio of ferrite in the disclosed spheroidal graphite cast iron is preferably 20% or more, more preferably 30% or more. Meanwhile, the area ratio of ferrite is preferably 55% or less, more preferably 50% or less. A ferrite area ratio of 20% or more provides better elongation and tenacity, and a ratio of 30% or more provides particularly good elongation and tenacity. A ferrite area ratio of 55% or less provides good tensile strength, and a ratio of 50% or less provides particularly good tensile strength.

Typically, a structure having a high ferrite area ratio has lower tensile strength. However, since the disclosed spheroidal graphite cast iron has a unique structure in which pearlite penetrates into the ferrite layer enclosing spheroidal graphite in an intricate manner, the cast iron has high strength with a tensile strength of 700 MPa or more even when the area ratio of ferrite is 20% to 55%.

Further, the area ratio of pearlite in the disclosed spheroidal graphite cast iron is preferably 45% or more, and preferably 80% or less. A pearlite area ratio of 45% or more provides better tensile strength, and a ratio of 50% or more provides particularly good tensile strength. A pearlite area ratio of 80% or less provides better elongation and tenacity, and a ratio of 70% or less provides particularly good elongation and tenacity.

In this specification, the area ratio of ferrite is calculated using the following formula by subjecting a micrograph of the metal structure in a cross section of a cast iron to image processing.

Area ratio of ferrite (%)=(Area of ferrite)/(Area of pearlite+Area of ferrite)×100

The total area of pearlite and ferrite in the structure is obtained by sampling a structure from the micrograph of a metal structure except for graphite and calculating the area of the structure. Further, the area of ferrite in the structure is obtained by sampling a structure from the micrograph of the metal structure except for graphite and pearlite, and calculating the area of the structure.

Further, in this specification, the area ratio of pearlite is calculated using the following formula.

Area ratio of pearlite (%)=100−Area ratio of ferrite

Further, the disclosed spheroidal graphite cast iron has a homogenized structure throughout the entire area. Specifically, in a portion of a Y-shaped sample that has parallel sides (hereinafter referred to as a parallel side portion) produced according to the disclosed method, the difference between the maximum value and the minimum value of the area ratios of ferrite is preferably 10% or less, more preferably 5% or less.

The spheroidizing ratio of the structure of the disclosed spheroidal graphite cast iron is 80% or more, and meets the standards of JIS G5502.

Spheroidal graphite cast irons having the above chemical compositions and structures have the following mechanical properties. The mechanical properties will now be described.

A spheroidal graphite cast iron of this disclosure has a tensile strength of 700 MPa or more, an elongation of 10% or more, and an absorbed energy of 10.0 J/cm$^2$ or more at room temperature. Accordingly, the disclosed spheroidal graphite cast iron has a tensile strength equivalent to that of grade FCD700 materials, an elongation equivalent to that of grade FCD450-10 materials and grade FCD550 materials, and a tenacity comparable to that of grade FCD450-10 materials and grade FCD550 materials.

The tensile strength and elongation are measured in conformity with JIS Z 2241. A 14 A tensile test specimen pursuant to JIS Z 2241 (circular cross sectional specimen, diameter: 6 mm) is made out of the spheroidal graphite cast iron by the turning process. The tensile test specimen is subjected to a tensile test using AUTOGRAPH AG-300kNXplus (manufactured by SHIMADZU CORPORATION) to measure the tensile strength and the elongation at break in conformity with JIS Z 2241. The absorbed energy is measured by the Charpy impact test pursuant to JIS Z 2242. A standard test specimen having a length of 55 mm and a 10 mm square cross section is cut out of the spheroidal graphite cast iron in conformity with JIS Z 2242. A U notch having a notch depth of 2 mm and a notch bottom radius of 1 mm is provided on the standard test specimen to prepare a U-notched test specimen. The U notch test specimen is subjected to the Charpy impact test using a 50 J impact test machine CI-50 (manufactured by TOKYO KOKI CO. LTD.) to measure the absorbed energy at room temperature.

With the above excellent mechanical properties, spheroidal graphite cast irons according to this disclosure can be used as materials of undercarriage parts such as steering knuckles, lower arms, upper arms, and suspensions, and materials of engine parts such as cylinder heads, crank shafts, and pistons. These parts are required of high tenacity.

A method of producing a spheroidal graphite cast iron, according to this disclosure will now be described.

First, a cast material having the above-described chemical composition is produced by a conventional method. The cast material obtained is subjected to soaking in which the material is retained at temperatures of 800° C. or more and 850° C. or less for a time of more than 30 min and 240 min or less. After the soaking, the spheroidal graphite cast iron having been subjected to soaking is cooled, thus a structure according to this disclosure is obtained.

Accordingly, the method of producing a spheroidal graphite cast iron, according to this disclosure is characterized in that the temperature of the structure of the cast material, that is, the pearlite phase and the ferrite phase, is raised to a temperature equal to or higher than the eutectoid transformation temperature to obtain the austenite phase, and soaking is then performed at a controlled temperature for a controlled time, thereby obtaining the desired structure.

Retention temperature for soaking: 800° C. or more and 850° C. or less

With the retention temperature for soaking being set within the above temperature range, a structure according to this disclosure can be obtained. Specifically, sufficient austenitization is not performed at retention temperatures less than 800° C., and the area ratio of ferrite in the structure after heat treatment would be excessively high, resulting in a tensile strength of less than 700 MPa. On the other hand, when the retention temperature is higher than 850° C., the area ratio of pearlite in the structure after heat treatment would be excessively high, resulting in an elongation and a tenacity that do not meet the intended mechanical properties. The retention temperature for soaking is preferably 805° C. or more, more preferably 810° C. or more. Meanwhile, the retention temperature for soaking is preferably 840° C. or less, more preferably 830° C. or less.

Retention time for soaking: Longer than 30 min and 240 min or shorter

When the retention time is 30 or shorter, austenitization is not sufficiently performed, thus the disclosed structure cannot be obtained after cooling to be described. When the retention time exceeds 240 min, the austenite structure would be coarse, which would result in reduced elongation or a reduced impact value after heat treatment. The retention time for soaking is preferably 60 min or longer, more preferably 100 min or longer. The retention time for soaking is preferably 200 min or shorter, more preferably 180 min or shorter.

Cooling after Soaking

The cooling rate is not limited, and the average cooling rate at least at temperatures of 800° C. to 600° C. in the neighborhood of the eutectoid transformation temperature is preferably set to 20° C./min or more.

In this specification, the average cooling rate at temperatures of A ° C. to B ° C. is calculated using the following formula.

$$\text{Average cooling rate}(^\circ\text{ C./min})=(A-B)/(\Delta t),$$

where Δt represents the time (min) required for the change of the temperature from A ° C. to B ° C.

For a cast material, especially when the product shape is complex, the cooling rate is not uniform in the cast material, so that a homogeneous structure would not be obtained throughout the entire area. However, increasing the average cooling rate at least at temperatures of 800° C. to 600° C. in the neighborhood of the eutectoid transformation temperature to a high rate of 20° C./min or more reduces the difference between the cooling rates of a thick part and a thin part of the product, thus the amount of ferrite and pearlite crystallized out by heat treatment can be fixed and the structure in the product can be homogenized. The average cooling rate at least at temperatures of 800° C. to 600° C. in the neighborhood of the eutectoid transformation temperature in cooling after soaking is more preferably 22° C./min or more. Meanwhile, the average cooling rate at least at temperatures of 800° C. to 600° C. in the neighborhood of the eutectoid transformation temperature in cooling after soaking is preferably 30° C./min or less. More preferably, the average cooling rate at temperatures from the temperature at which soaking is terminated to 600° C. is 20° C./min or more, still more preferably 22° C./min or more. The average cooling rate at temperatures from the temperature at which soaking is terminated to 600° C. is more preferably 30° C./min or less.

Example 1

Feedstocks for Fe—Si-based molten metals were prepared. The feedstocks were melted using a high frequency electric furnace to obtain Fe—Si-based molten metals. A spheroidizing agent (Fe—Si—Mg) was added to each molten metal to perform spheroidization. Next, an Fe—Si alloy containing Ba, S, and RE (Si: 70% to 75%) was added as an inoculant such that it provides approximately 0.2% of the whole molten metal to obtain the compositions given in Table 1. Compositions 1 to 2 in Table 1 correspond to molten metals within the range specified by the composition of this disclosure, and Compositions 3 to 5 correspond to molten metals out of the range specified by the composition of this disclosure.

TABLE 1

| | Chemical Composition | | | | | | | | | |
|---|---|---|---|---|---|---|---|---|---|---|
| | C (mass %) | Si (mass %) | Mn (mass %) | P (mass %) | S (mass %) | Cr (mass %) | Cu (mass %) | Mg (mass %) | Mn + Cu (mass %) | Note |
| Composition 1 | 3.68 | 2.14 | 0.27 | 0.015 | 0.006 | 0.029 | 0.32 | 0.042 | 0.59 | Conforming Example |
| Composition 2 | 3.68 | 2.21 | 0.28 | 0.018 | 0.005 | 0.023 | 0.47 | 0.047 | 0.75 | Conforming Example |
| Composition 3 | 3.74 | 2.20 | 0.60 | 0.018 | 0.005 | 0.026 | 0.07 | 0.044 | 0.67 | Comparative Example |
| Composition 4 | 3.62 | 2.48 | 0.26 | 0.015 | 0.006 | 0.027 | 0.42 | 0.040 | 0.68 | Comparative Example |
| Composition 5 | 3.48 | 2.90 | 0.27 | 0.015 | 0.006 | 0.024 | 0.51 | 0.048 | 0.78 | Comparative Example |

In recent years, knuckles reduced in weight (hereinafter, lightweight knuckles) that are a kind of vehicle undercarriage parts are designed with a complex shape. Lightweight knuckles are reduced in thickness as compared with conventional knuckles; however, bolt joints are not reduced in thickness with a view to securing the strength, which results in variations of the thickness in the products. However, according to this disclosure, a high average cooling rate of 20° C./min or more at temperatures of 800° C. to 600° C. in the neighborhood of the eutectoid transformation temperature can make the structure in the products homogeneous and makes it possible to manufacture lightweight knuckles meeting the required properties throughout the entire area.

Examples of a method of cooling after soaking includes, for example, but not limited to an air cooling method. Performing cooling by air cooling makes it possible to obtain an average cooling rate of 20° C./min or more. Further, performing cooling by air cooling eliminates the need for special setups such as a setup for controlling the cooling rate, thus, the method is suitable for mass production.

Note that although the method of producing a cast material is not specifically limited, an inoculant is preferably added in casting. For the inoculant, an Fe—Si alloy (ferrosilicon) containing at least two selected from the group consisting of Ca, Ba, Al, S, and RE is preferably used. The inoculation method is not limited, and may be selected from for example ladle inoculation, stream inoculation, and in-mold inoculation depending on the shape of products, the thickness of products, etc.

Figure 1B:
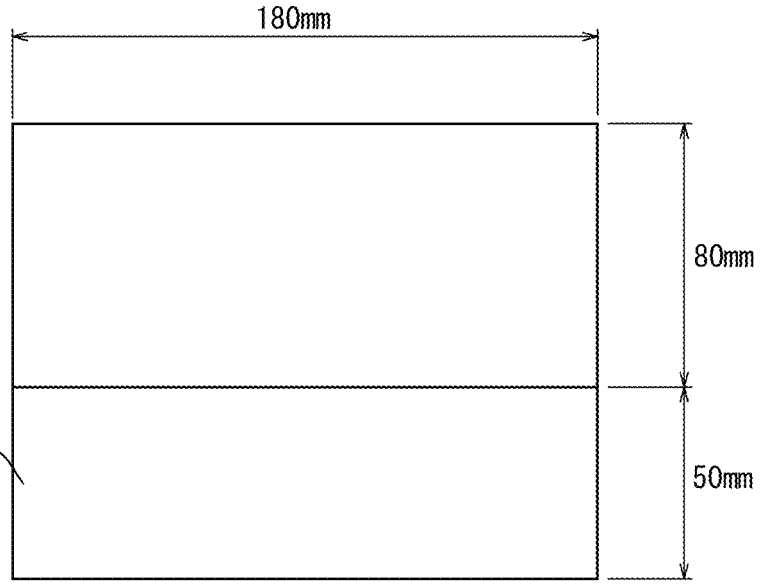

A mold having a cavity shape depicted in FIGS. 1A and 1B was formed by the Betaset process. FIG. 1A illustrates the dimensions of the side shape of the cavity, and FIG. 1B illustrates the dimensions of the front shape of the cavity. As illustrated in FIG. 1A, the cavity had a Y-shaped side shape such that the thickness of an upper side portion on the hot top side was 45 mm, the thickness was gradually reduced to 10 mm from the upper side portion to a lower portion, and the thickness of the rest of the cavity forming a parallel side portion 100 was fixed (10 mm). Note that the thickness of the cavity was determined for thin portions of vehicle undercarriage parts and engine parts. The molten metal was poured into the mold. After the molten metal was cooled to room temperature inside the mold, a Y-shaped raw cast product (casting) was taken out of the mold.

The raw cast product obtained was subjected to soaking. For the soaking, a side-door electric furnace manufactured by KYOEI ELECTRIC KILNS CO., LTD. was used. The soaking was performed with the raw cast product being set as it was, for example, without being cut. The retention temperature for soaking was selected from a range of 750° C. to 900° C. The processing time for soaking was selected from a range of 30 min to 240 min.

The retention temperature and the processing time for Examples and Comparative Examples are given in Table 2.

TABLE 2

Review of Composition and Heat Treatment Conditions

| No. | Composition | Soaking: Subjected to soaking | Soaking: Retention temperature (° C.) | Soaking: Retenion time (min) | Cooling: rate (° C./min) | Note |
|---|---|---|---|---|---|---|
| 1 | Composition 1 | No (As cast) | — | — | — | Comparative Example |
| 2 | Composition 1 | Yes | 900 | 100 | 23.8 | Comparative Example |
| 3 | Composition 1 | Yes | 850 | 100 | 27.8 | Invention Example |
| 4 | Composition 1 | Yes | 800 | 100 | 28.2 | Invention Example |
| 5 | Composition 1 | Yes | 750 | 100 | 35.9 | Comparative Example |
| 6 | Composition 1 | Yes | 850 | 30 | 29.4 | Comparative Example |
| 7 | Composition 1 | Yes | 820 | 100 | 28.7 | Invention Example |
| 8 | Composition 1 | Yes | 810 | 180 | 22.9 | Invention Example |
| 9 | Composition 1 | Yes | 800 | 240 | 22.0 | Invention Example |
| 10 | Composition 3 | No (As cast) | — | — | — | Comparative Example |
| 11 | Composition 3 | Yes | 900 | 100 | 25.4 | Comparative Example |
| 12 | Composition 3 | Yes | 850 | 100 | 26.5 | Comparative Example |
| 13 | Composition 3 | Yes | 830 | 100 | 22.5 | Comparative Example |

A Y-shaped sample was obtained by cooling the raw cast product having been subjected to soaking. The cooling of the raw cast product was performed by cooling by fully opening the furnace door after terminating heating of the electric furnace (air cooling). At the same time as cooling, the average cooling rate for the raw cast product was measured. An opening having a depth of 15 mm was formed in a center portion of the bottom surface of the parallel side portion 100 of the Y shape of the raw cast product (a center portion in the width direction of the bottom surface and the thickness direction), and a thermocouple was inserted into the opening. Data of temperatures measured using the thermocouple were acquired by a data logger GL200 manufactured by GRAPHTEC Corporation, and the average cooling rate at temperatures of 800° C. to 600° C. in the neighborhood of the eutectoid transformation temperature. After cooling to room temperature, the Y-shaped sample was taken.

Figure 2A:
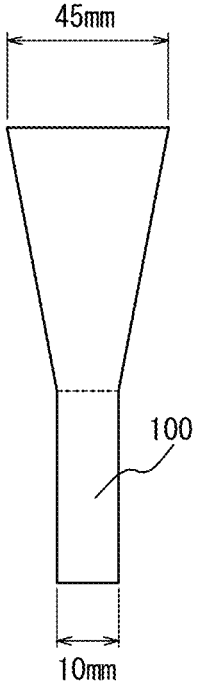
FIG. 2A is a diagram illustrating the position where a test specimen was sampled from the Y-shaped sample under structure observation in Example 1 and FIG. 2B is a diagram illustrating a region of the sample that was subjected to microscopy.
Figure 2B:
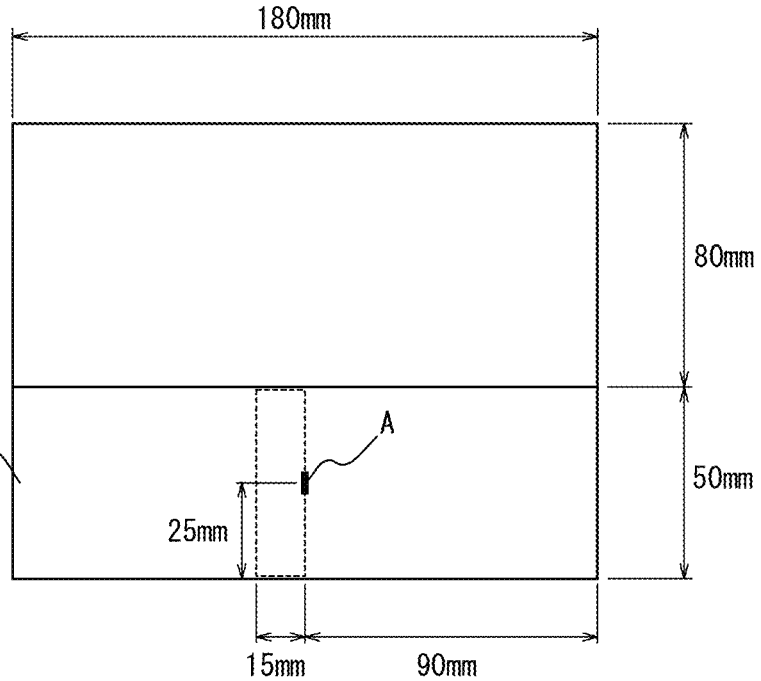

The structure of the Y-shaped sample obtained was observed as described below. The structure observation was performed on the center portion of the parallel side portion (a region located at the center in the height direction, the width direction, and the thickness direction of the parallel side portion 100). First, as illustrated by the broken line in FIG. 2B, test specimens having a width of 15 mm and a thickness of 10 mm were each sampled by cutting out a cross sectional plane parallel with the side surface at a position of 90 mm from the right side surface in FIG. 2B from the parallel side portion 100 of the Y-shaped sample. The cross section of each test specimen was subjected to mirror finishing. An observation surface A on the mirror-finished cross section (a region located at the center in the height direction and the width direction of the mirror-finished cross section) was observed under an optical microscope with a magnification of 100×, and a micrograph was taken. The micrographs obtained are given in FIGS. 3 to 5.

Figure 3:
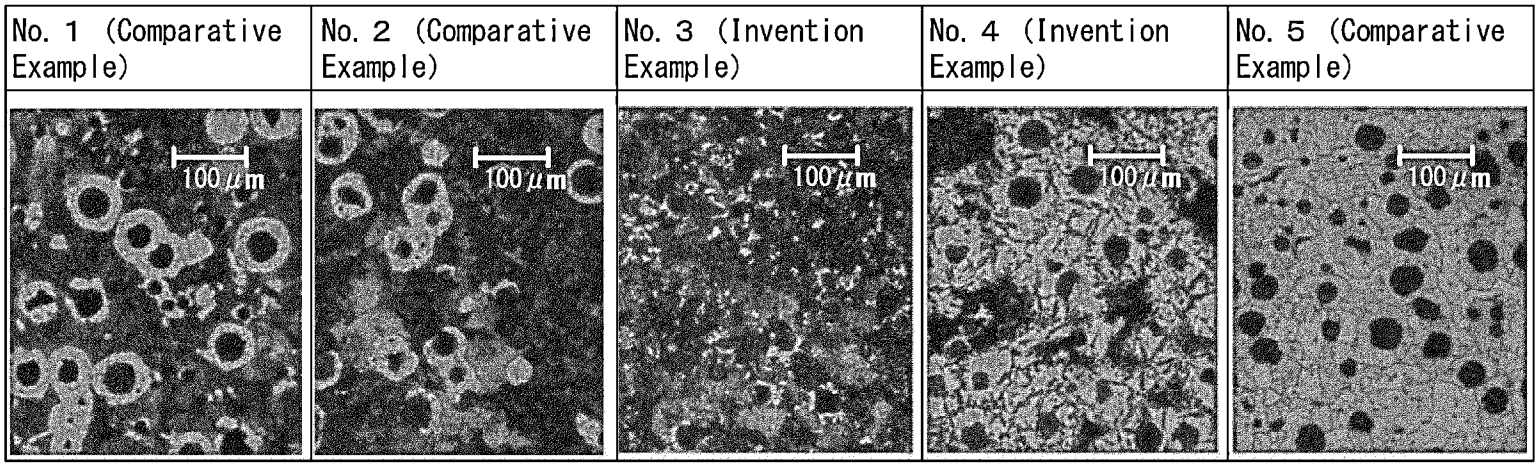
FIG. 3 includes micrographs of the structure of samples Nos. 1 to 5 in Example 1.

FIG. 3 includes micrographs of the structure of samples No. 1 to 5 of Table 2. As given in Table 2, the samples Nos. 1 to 5 were experimental examples of performing soaking on the raw cast product cast using the molten metal of Composition 1 at retention temperatures of 750° C. to 900° C. for a certain retention time. By comparing the samples Nos. 1 to 5, the influences of the retention temperatures for soaking on the structures were studied. As illustrated in FIG. 3, a structure of this disclosure was found to be obtained at retention temperatures of 800° C. to 850° C. In Comparative Examples in which the retention temperature was set to 750° C. or 900° C., the structure did not form a structure of this disclosure and formed a bull's eye structure as with the cast material of the sample No. 1.

Figure 4:
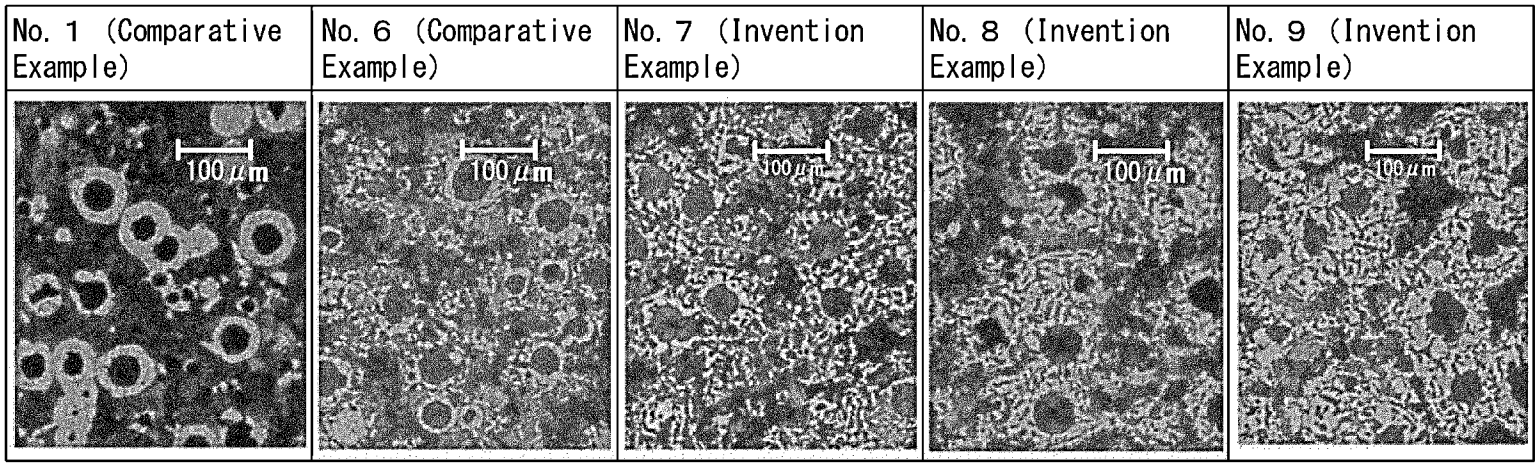
FIG. 4 includes micrographs of the structure of samples Nos. 6 to 9 in Example 1 and the structure of the sample No. 1.

FIG. 4 includes micrographs of the structure of samples Nos. 6 to 9 in Example 1 and the structure of the sample No. 1. As given in Table 2, the samples Nos. 6 to 9 were experimental examples of performing soaking on the raw cast product cast using the molten metal of Composition 1 for a retention time of 30 min to 240 min. The retention temperature was appropriately selected from 800° C. to 850° C. so that the matrix structure would not be all ferrite. By comparing the samples Nos. 6 to 9, the influences of the retention time for soaking on the structure were studied. For comparison, the structure of No. 1 was given in FIG. 4 as a comparative example which had not been subjected to soaking. As illustrated in FIG. 4, a structure of this disclosure was found to be obtained with a retention time for soaking of more than 30 min and 240 min or less. With a retention time of 30 min, most of ferrite remained around graphite, and a ring-shaped ferrite layer was not divided by fine pearlite phases, thus a structure of this disclosure was not obtained.

Figure 5:
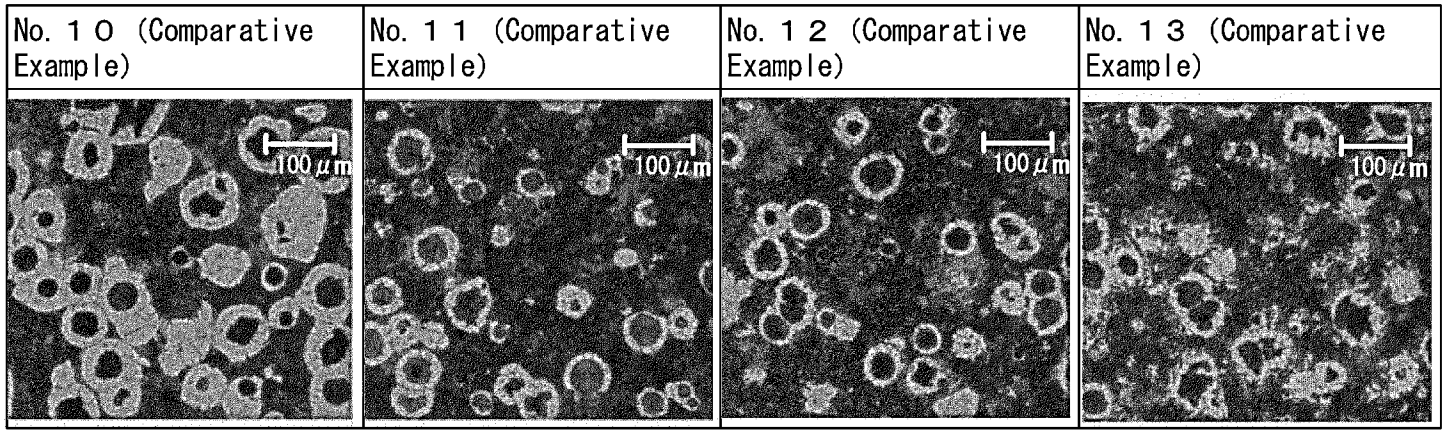
FIG. 5 includes micrographs of the structure of samples Nos. 10 to 13 in Example 1.

FIG. 5 includes micrographs of the structure of samples Nos. 10 to 13 in Example 1. As given in Table 2, the samples Nos. 10 to 13 were experimental examples of performing soaking on the raw cast product cast using the molten metal of Composition 3 at retention temperatures of 830° C. to 900° C. for a certain retention time. For Composition 3, instead of adding Cu, the content of Mn was increased, so that the total content of Mn and Cu was within the range specified in this disclosure. As given in Table 1, Composition 3 contained 0.07% of Cu, which however was inevitably incorporated from the feedstock. As given in FIG. 5, when Composition 3 was used, a structure of this disclosure was not obtained at any retention temperature, and a structure obtained had the bull's eye structure as with the cast material.

The above demonstrates that a structure of this disclosure can be obtained by performing heat treatment under the conditions of retention at retention temperatures of 800° C. or more and 850° C. or less for a retention time of more than 30 min and 240 min or less followed by cooling, and that the structure must have a chemical composition obtained by adding Cu.

Example 2

Cast irons were produced in the same manner as in Example 1 except that the composition of the molten metals and the heat treatment conditions for raw cast products were changed to those given in Table 3.

For each cast iron obtained, the structure was observed as described below and the hardness, tensile strength, elongation, and the Charpy absorbed energy at room temperature were measured.

First, the structure observation and the hardness measurement are described. To also evaluate the homogeneity of the structure in each Y-shaped sample, the structure observation and the hardness measurement were performed on two portions: an upper portion of the parallel side portion 100 (a region located at a height of 45 mm from the bottom of the parallel side portion 100 and at the center in the width direction and the thickness direction of the parallel side portion 100) and a bottom portion (a region at a height of 5 mm from the bottom of the parallel side portion 100 and at the center in the width direction and the thickness direction of the parallel side portion 100).

Figure 6A:
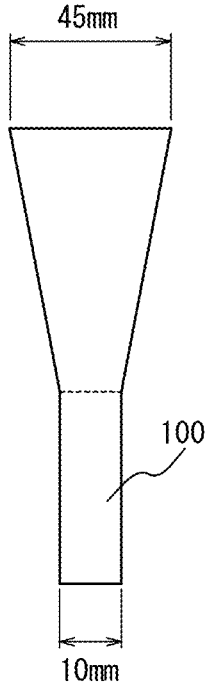
FIG. 6A is a diagram illustrating a position where a test specimen was sampled from the Y-shaped sample under structure observation and hardness measurement in Example 2 and FIG. 6B is a diagram illustrating a region of the sample that was subjected to microscopy.
Figure 6B:
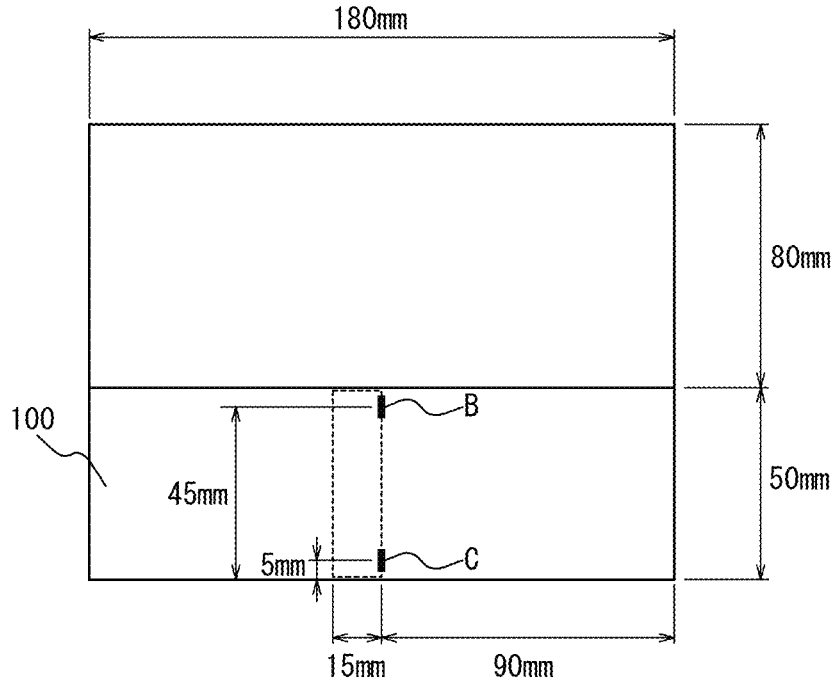

As illustrated by the broken line in FIG. 6B, test specimens having a width of 15 mm and a thickness of 10 mm were each sampled by cutting out a cross sectional plane parallel with the side surface at a position of 90 mm from the right side surface in FIG. 6B from the parallel side portion 100 of the Y-shaped sample. The cross section of each test specimen was subjected to mirror finishing. An observation surface B on the mirror-finished cross section (a region located at a height of 45 mm from the bottom and at the center in the width direction of the mirror-finished cross section) and an observation surface C on the same cross section (a region located at a height of 5 mm from the bottom and at the center in the width direction of the mirror-finished cross section) were observed under an optical microscope with a magnification of 100×, and a micrograph was taken.

Figure 8:
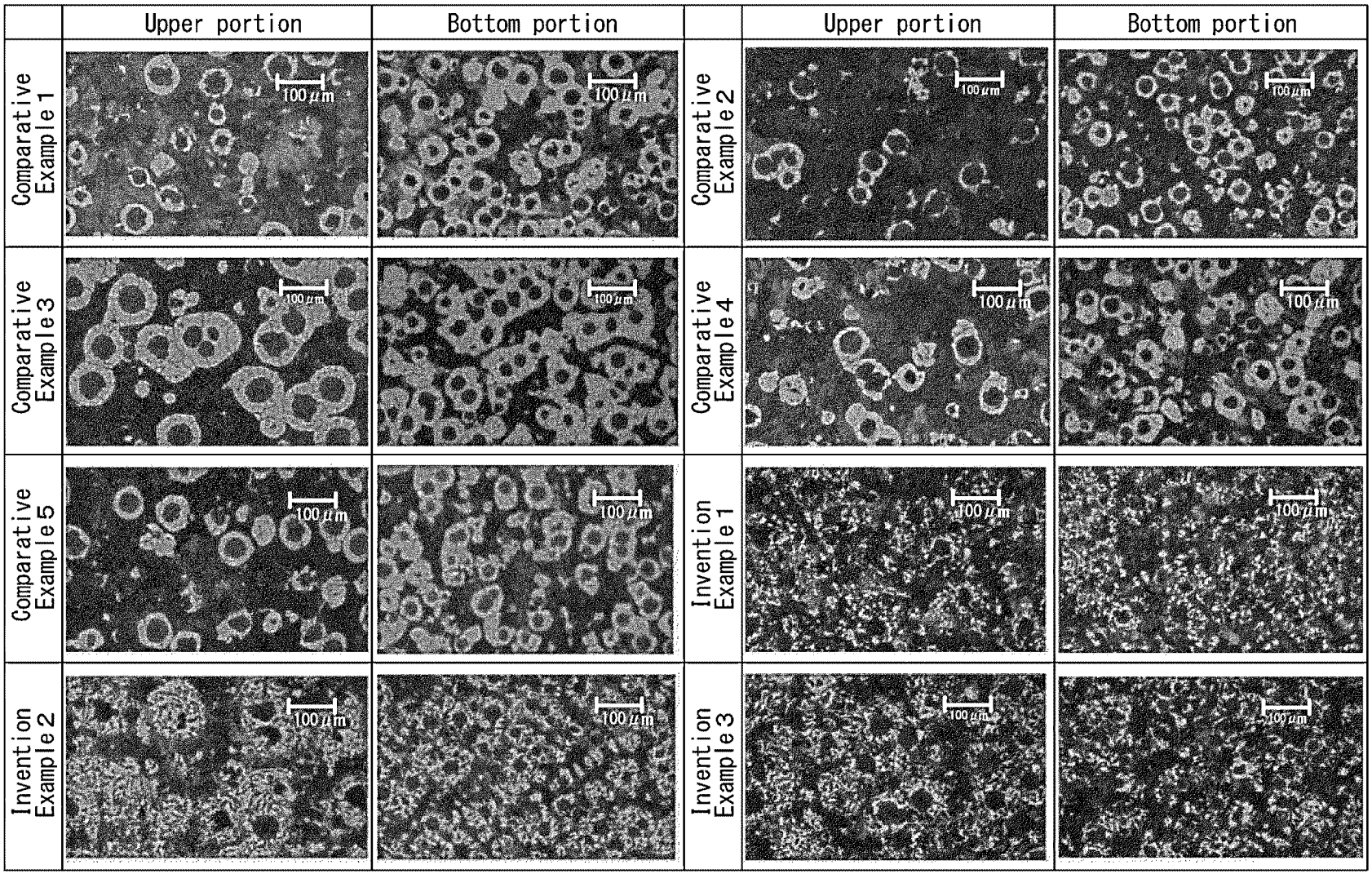
FIG. 8 includes micrographs of the structure of samples in Comparative Examples 1 to 5 and Invention Examples 1 to 3 for Example 2.
Figure 9:
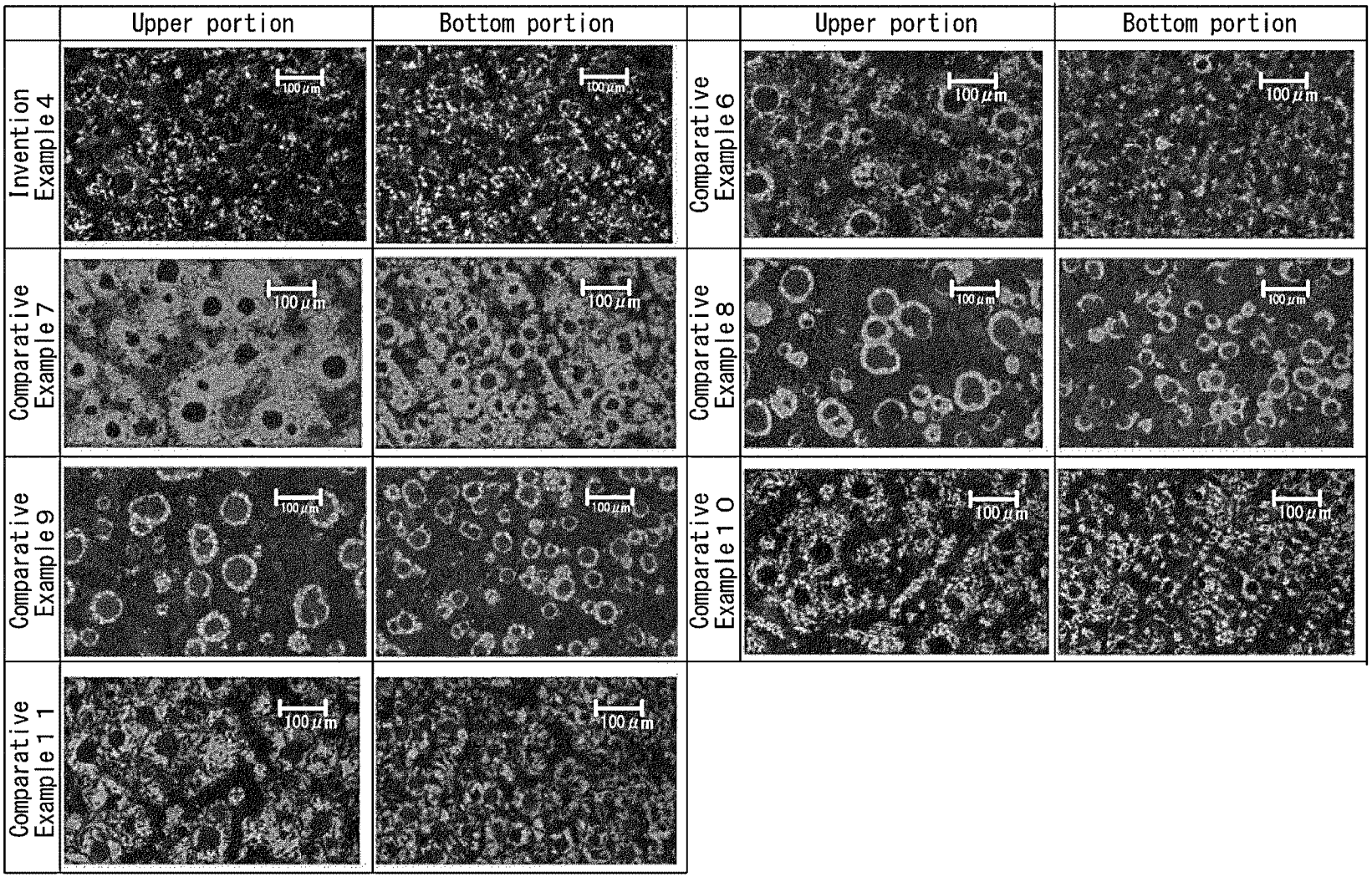
FIG. 9 includes micrographs of the structure of samples in Invention Example 4 and Comparative Examples 6 to 11 for Example 2.

The structure observation on each test specimen and the micrograph taking was performed in the same manner as in Example 1. The structure micrographs are given in FIGS. 8 and 9.

Further, the area ratio of ferrite in the structure, the number of graphite grains, and the graphite grain size were measured using an image analysis system QuickGrain Pro (available from Inotech Co., Ltd.). The measurements were performed in conformity with JIS G 5502. Graphite having an average grain size of 10 μm or more as spheroidal graphite was subjected to the measurement of the number of graphite grains and the graphite grain size. Further, the spheroidizing ratio was calculated in conformity with JIS G 5502. The variation (difference) between the measured values of the spheroidizing ratio and the ferrite area ratio between the two test specimens for the upper portion and the bottom portion in the parallel side portion 100 of each Y-shaped sample was determined and are given in Table 3.

The hardness of each test specimen was found by measuring the hardness of observation surface B and the observation surface C on the cross section of the test specimen described above by a Rockwell hardness testing machine AR-10 (manufactured by Mitutoyo Corporation). The measurements were performed in accordance with the instruction manual provided by the manufacturer.

Figure 7A:
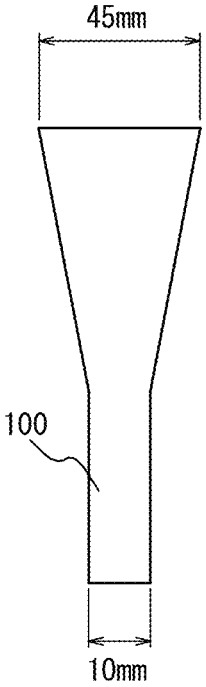
FIGS. 7A and 7B are diagrams illustrating the positions where a test specimen for a tensile test and an impact test in Example 2 was sampled.
Figure 7B:
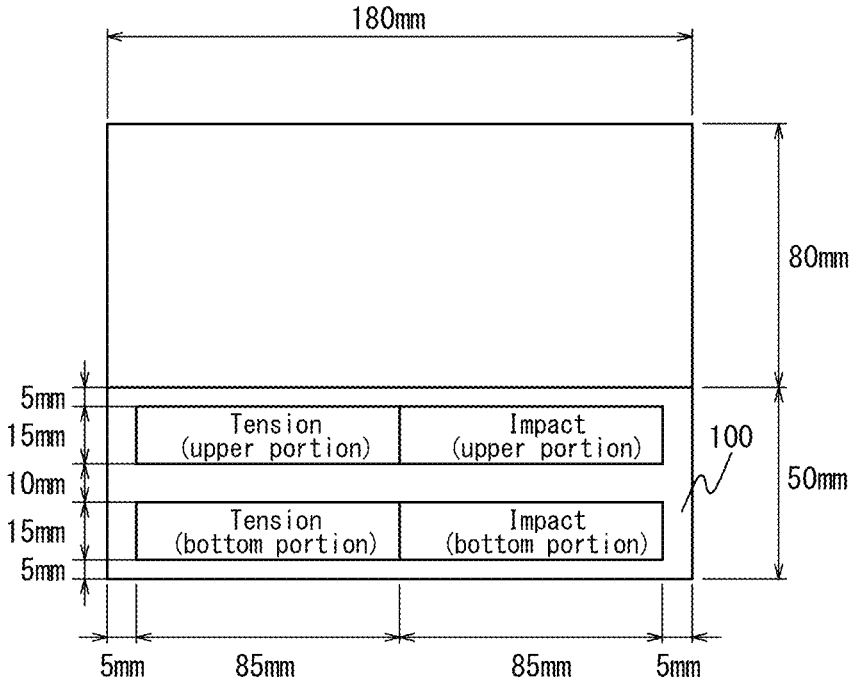

Next, measurements of the tensile strength and the Charpy absorbed energy are described. FIG. 7B illustrates the positions of sampling test specimens. To also evaluate the homogeneity of the structure in each Y-shaped sample, one test specimen was taken from each of two portions: an upper portion of the parallel side portion 100 (a region at heights from 30 mm to 45 mm from the bottom of the parallel side portion 100) and a bottom portion (a region at heights from 5 mm to 20 mm from the bottom of the parallel side portion 100).

Tensile tests were performed in conformity with JIS Z 2241. First, 14 A tensile test specimens in accordance with JIS Z 2241 (circular cross-sectional test specimen, diameter: 6 mm) were prepared by the turning process from the two sampling positions depicted in FIG. 7B, that is, the upper portion (the section at heights from 30 mm to 45 mm from the bottom of the parallel side portion 100 and at 5 mm to 90 mm in the thickness direction from the left side surface in FIG. 7B) and the bottom portion (the section at heights from 5 mm to 20 mm from the bottom of the parallel side portion 100 and at 5 mm to 90 mm in the thickness direction from the left side surface in FIG. 7B). The two tensile test specimens were each subjected to tensile tests using AUTOGRAPH AG-300kNXplus (manufactured by SHIMADZU CORPORATION) to measure the 0.2 offset yield strength, tensile strength, and elongation at break. The measurement results of the tensile strength and the elongation at break are given in Table 3. The variation (difference) between the measured values of the tensile strength and the elongation at break between the test specimen taken from the upper portion in the parallel side portion 100 of the Y-shaped sample and the test specimen taken from the bottom portion in the parallel side portion 100 of the Y-shaped sample was determined and is given in Table 3.

The Charpy impact tests were performed in conformity with JIS Z 2242. First, in conformity with JIS Z 2242, a standard test specimen having a length of 55 mm, with the direction of the thickness of a Y-shaped sample being defined as the longer direction, and a square cross section with sides of 10 mm was cut out of the Y-shaped sample from the two sampling positions depicted in FIG. 7B, that is, the upper portion (the section at heights of 30 mm to 45 mm from the bottom of the parallel side portion 100 and at 5 mm to 90 mm in the thickness direction from the right side surface in FIG. 7B) and the bottom portion (the section at heights of 5 mm to 20 mm from the bottom of the parallel side portion 100, and at 5 mm to 90 mm in the thickness direction from the right side surface in FIG. 7B). A U notch having a notch depth of 2 mm and a notch bottom radius of 1 mm was provided on the standard test specimen to prepare a U-notched test specimen. The U notch test specimen was subjected to the Charpy impact test using a 50 J impact test machine CI-50 (manufactured by TOKYO KOKI CO. LTD.) to measure the absorbed energy at room temperature. The measurement results are given in Table 3. The variation (difference) between the measured values of the absorbed energy between the test specimen taken from the upper portion in the parallel side portion 100 of the Y-shaped sample and the test specimen taken from the bottom portion in the parallel side portion 100 of the Y-shaped sample was determined and is given in Table 3.

TABLE 3

Review of Mechanical Properties

| | | Soaking | | | | | Structure | | Mechanical properties | | |
|---|---|---|---|---|---|---|---|---|---|---|---|
| | | Subjected to soaking | Retention temperature (° C.) | Retention time (min) | Cooling rate (° C./min) | Specimen sampling position | Sphero-idizing ratio (%) | Ferrite area ratio (%) | Tensile strength (MPa) | Elongation at break (%) | Absorbed energy (J/cm$^2$) |
| Comparative Example 1 | Com-position 1 | No (As cast) | — | — | — | Upper portion | 90.6 | 19.5 | 717.5 | 11.0 | 9.7 |
| | | | | | | Bottom portion | 92.5 | 44.0 | 683.4 | 10.2 | 13.4 |
| | | | | | | Variation | 1.9 | 24.5 | 34.1 | 0.8 | 3.7 |
| Comparative Example 2 | Com-position 2 | No (As cast) | — | — | — | Upper portion | 89.2 | 10.2 | 785.0 | 8.8 | 6.0 |
| | | | | | | Bottom portion | 93.5 | 28.9 | 727.3 | 10.0 | 9.8 |
| | | | | | | Variation | 4.3 | 18.7 | 57.7 | 1.2 | 3.8 |
| Comparative Example 3 | Com-position 3 | No (As cast) | — | — | — | Upper portion | 86.9 | 40.2 | 634.9 | 12.4 | 10.2 |
| | | | | | | Bottom portion | 91.4 | 68.1 | 604.8 | 13.2 | 10.6 |
| | | | | | | Variation | 4.5 | 27.9 | 30.1 | 0.8 | 0.4 |
| Comparative Example 4 | Com-position 4 | No (As cast) | — | — | — | Upper portion | 87.6 | 22.9 | 770.9 | 10.3 | 6.8 |
| | | | | | | Bottom portion | 93.7 | 44.7 | 740.3 | 11.2 | 10.5 |
| | | | | | | Variation | 6.1 | 21.8 | 30.6 | 0.9 | 3.7 |
| Comparative Example 5 | Com-position 5 | No (As cast) | — | — | — | Upper portion | 91.9 | 22.5 | 782.2 | 10.1 | 8.5 |
| | | | | | | Bottom portion | 95.1 | 38.7 | 739.3 | 11.5 | 11.2 |
| | | | | | | Variation | 3.2 | 16.2 | 42.9 | 1.4 | 2.7 |
| Invention Example 1 | Com-position 1 | Yes | 820 | 180 | 28.0 | Upper portion | 88.1 | 23.2 | 791.5 | 10.3 | 10.2 |
| | | | | | | Bottom portion | 86.2 | 25.9 | 787.1 | 10.5 | 10.6 |
| | | | | | | Variation | 1.9 | 2.7 | 4.4 | 0.2 | 0.4 |
| Invention Example 2 | Com-position 1 | Yes | 810 | 180 | 22.9 | Upper portion | 88.7 | 38.2 | 726.1 | 11.5 | 11.3 |
| | | | | | | Bottom portion | 94.2 | 39.0 | 721.7 | 12.9 | 10.9 |
| | | | | | | Variation | 5.5 | 0.8 | 4.4 | 1.4 | 0.4 |
| Invention Example 3 | Com-position 1 | Yes | 820 | 100 | 28.7 | Upper portion | 88.3 | 39.3 | 732.8 | 10.8 | 11.4 |
| | | | | | | Bottom portion | 94.0 | 37.1 | 742.8 | 11.8 | 11.9 |
| | | | | | | Variation | 5.7 | 2.2 | 10.0 | 1.0 | 0.5 |
| Invention Example 4 | Com-position 1 | Yes | 830 | 100 | 22.5 | Upper portion | 88.5 | 21.7 | 796.2 | 10.4 | 10.0 |
| | | | | | | Bottom portion | 93.4 | 30.6 | 802.9 | 10.2 | 10.7 |
| | | | | | | Variation | 4.9 | 8.9 | 6.7 | 0.2 | 0.7 |
| Comparative Example 6 | Com-position 1 | Yes | 850 | 30 | 29.4 | Upper portion | 91.0 | 19.3 | 750.7 | 11.3 | 12.0 |
| | | | | | | Bottom portion | 92.0 | 10.8 | 766.5 | 9.5 | 10.7 |
| | | | | | | Variation | 1.2 | 8.5 | 15.8 | 1.8 | 1.3 |
| Comparative Example 7 | Com-position 1 | Yes | 820 | 30 | 30.3 | Upper portion | 92.2 | 57.2 | 609.9 | 14.2 | 13.2 |
| | | | | | | Bottom portion | 94.6 | 56.6 | 620.1 | 14.6 | 13.9 |
| | | | | | | Variation | 2.4 | 0.6 | 10.2 | 0.4 | 0.7 |
| Comparative Example 8 | Com-position 1 | Yes | 900 | 100 | 23.8 | Upper portion | 87.9 | 23.7 | 744.4 | 10.6 | 9.5 |
| | | | | | | Bottom portion | 90.0 | 20.9 | 762.5 | 9.7 | 10.2 |
| | | | | | | Variation | 2.1 | 2.8 | 18.1 | 0.9 | 0.7 |
| Comparative Example 9 | Com-position 3 | Yes | 850 | 100 | 26.5 | Upper portion | 84.2 | 22.8 | 743.9 | 10.1 | 9.7 |
| | | | | | | Bottom portion | 95.4 | 26.4 | 751.1 | 9.6 | 11.3 |
| | | | | | | Variation | 11.2 | 3.6 | 7.2 | 0.5 | 1.6 |
| Comparative Example 10 | Com-position 4 | Yes | 830 | 100 | 25.3 | Upper portion | 89.1 | 37.6 | 778.5 | 10.9 | 10.2 |
| | | | | | | Bottom portion | 92.3 | 37.6 | 777.4 | 10.9 | 9.7 |
| | | | | | | Variation | 3.2 | 0.0 | 1.1 | 0.0 | 0.5 |
| Comparative Example 11 | Com-position 5 | Yes | 835 | 100 | 24.0 | Upper portion | 86.1 | 38.8 | 752.1 | 13.9 | 9.7 |
| | | | | | | Bottom portion | 93.7 | 35.6 | 753.8 | 12.6 | 9.0 |
| | | | | | | Variation | 7.6 | 3.2 | 1.7 | 1.3 | 0.7 |

Although not given in Table 3, there was no significant difference in Rockwell hardness between the test specimens of Invention Examples and Comparative Examples, and the Rockwell hardness was within a range of 88.3 HRB to 100.5 HRB. There was no significant difference in number of graphite grains in the structure between Invention Examples and Comparative Examples, and the number was within a range of 130.6/mm$^2$ to 299.4/mm$^2$. There was no significant difference in grain size of graphite in the structure between Invention Examples and Comparative Examples, and the grain size was within a range of 20.4 μm to 32.5 μm. There was no significant difference in 0.2% offset yield strength of the test specimen between Invention Examples and Comparative Examples, and the 0.2% offset yield strength was within a range of 353.5 MPa to 468.1 MPa.

None of the cast materials in Comparative Examples 1 to 5 met the mechanical properties of: high strength with a tensile strength of 700 MPa or more, an elongation of 10% or more, and an absorbed energy of 10.0 J/cm$^2$ or more at room temperature throughout the entire area of each Y-shaped sample. Although some of Comparative Examples 1 to 5 met the intended mechanical properties of this disclosure: tensile strength, elongation, and tenacity; the ferrite area ratios of the upper portion and the bottom portion of the Y-shaped sample had a difference of approximately 20 percent points, which indicates that a homogeneous structure was not obtained.

Invention Examples 1 to 4 met the intended mechanical properties. Further, the ferrite area ratio was 20% to 55%, and the variation of the ferrite area ratio was as small as less than 10 percent points in each Invention Example, which indicates that a homogeneous structure was obtained. Note that Invention Examples 1 to 4 demonstrate that the variation of the area ratio of ferrite in each Y-shaped sample had a tendency to be smaller when the retention temperature for soaking was lower and the retention time for soaking was longer.

Comparative Examples 6 and 7 are examples in which the retention time was shorter to be out of the range of the intended heat treatment conditions. Conventional Example 6 did not meet the intended mechanical properties in terms of elongation. The structure micrographs demonstrate that the structures obtained were like the bull's eye structure instead of fully forming the structure of this disclosure. The ferrite area ratio was also as low as less than 20%. Further, since the retention time for soaking was short in Comparative Example 7, austenitization was not sufficient, resulting in a ferrite area ratio of more than 55% after heat treatment, and a tensile strength of less than 700 MPa.

In Comparative Example 8, the retention temperature was higher to be out of the range of the intended heat treatment conditions. Although the tensile strength was on the order of 700 MPa, the elongation and tenacity did not meet the intended mechanical properties. As seen in the structure micrograph, the disclosed structure was not obtained, and a bull's eye structure was formed.

In Comparative Example 9, the total content of Cu and Mn was out of the range specified by the composition of this disclosure. Although the tensile strength was higher than 700 MPa, the elongation and tenacity did not meet the intended mechanical properties. As seen in the structure micrograph, the disclosed structure was not obtained, and a bull's eye structure was formed.

In Comparative Example 10, the content of Si was out of the range specified by the composition of this disclosure. The tensile strength was on the order of 700 MPa, the ferrite area ratio was 20% or more, and the structure micrograph also demonstrates that the obtained structure had a similar form to the disclosed structure, yet the tenacity did not meet the intended mechanical properties. In Comparative Example 10, the content of Si in the chemical composition was high, so that silicon ferrite having low tenacity may have been produced, which might have resulted in the reduced tenacity.

In Comparative Example 11, the content of Si was further out of the range specified by the composition of this disclosure as compared with that in Comparative Example 10. The tensile strength was on the order of 700 MPa, the ferrite area ratio was 20% or more, and the structure micrograph demonstrates that a structure of this disclosure was obtained, yet the tenacity was even lower than that in Comparative Example 10.

As described above, this disclosure provides a spheroidal graphite cast iron having high strength, high ductility, and high tenacity throughout the entire area of a Y-shaped sample.

REFERENCE SIGNS LIST

A, B, C: Observation surface

100: Parallel side portion

The invention claimed is:

1. A spheroidal graphite cast iron comprising:

a chemical composition consisting of:

C: 3.0% to 4.0%,

Si: 2.0% to 2.4%,

Cu: 0.20% to 0.50%,

Mn: 0.15% to 0.35%,

S: 0.005% to 0.030%,

Mg: 0.03% to 0.06%, each by mass, and the balance being Fe and inevitable impurities, where Mn and Cu are contained at 0.45% to 0.75% in total; and a structure in which a spheroidal graphite and a ferrite layer which is situated around and forming a boundary with the spheroidal graphite are crystallized out in a matrix of pearlite, wherein in the structure, part of the pearlite penetrates from the matrix of pearlite into the ferrite layer and reaches a boundary of the ferrite layer and the spheroidal graphite at one or more areas, the ferrite layer has cluster of grains that are connected and joined to each other, wherein the cast iron has a tensile strength of 700 MPa or more and an elongation of 10% or more.

2. The spheroidal graphite cast iron according to claim 1, wherein the cast iron has an absorbed energy at room temperature is 10.0 J/cm$^2$ or more.

3. The spheroidal graphite cast iron according to claim 1, wherein an area ratio of the ferrite layer relative to the entire structure is 20% to 55%.

4. A method of producing the spheroidal graphite cast iron of claim 1, comprising:

performing soaking on a cast material having a chemical composition consisting of:

C: 3.0% to 4.0%,

Si: 2.0% to 2.4%,

Cu: 0.20% to 0.50%,

Mn: 0.15% to 0.35%,

S: 0.005% to 0.030%,

Mg: 0.03% to 0.06%, each by mass, and the balance being Fe and inevitable impurities, where Mn and Cu are contained at 0.45% to 0.75% in total, by retaining the cast material at temperatures of 800° C. or more and 850° C. or less for a time of more than 30 min and 240 min or less; and cooling the cast material after the soaking.

5. A vehicle undercarriage part comprising the spheroidal graphite cast iron according to claim 1.

6. The spheroidal graphite cast iron according to claim 2, wherein an area ratio of the ferrite layer relative to the entire structure is 20% to 55%.

7. A vehicle undercarriage part comprising the spheroidal graphite cast iron according to claim 2.

8. A vehicle undercarriage part comprising the spheroidal graphite cast iron according to claim 3.

9. A vehicle undercarriage part comprising the spheroidal graphite cast iron according to claim 6.

* * * * *